United States Patent [19]

Wahhoud et al.

[11] Patent Number: 5,031,669

[45] Date of Patent: Jul. 16, 1991

[54] WEFT THREAD MONITOR WITH CONTROL CIRCUIT TO ELIMINATE FALSE WEFT DEFECT SIGNALS

[75] Inventors: Adnan Wahhoud, Bodolz; Dieter Teufel, Langenargen, both of Fed. Rep. of Germany

[73] Assignee: Lindauer Dornier Gesellschaft m.b.H., Lindau/Bodensee, Fed. Rep. of Germany

[21] Appl. No.: 456,165

[22] Filed: Dec. 22, 1989

[30] Foreign Application Priority Data

Dec. 23, 1988 [DE] Fed. Rep. of Germany ..... 3843683

[51] Int. Cl.[5] ..... D03D 47/30; D03D 51/34

[52] U.S. Cl. ..... 139/370.2; 139/435.1; 139/435.5; 139/452

[58] Field of Search ..... 139/435.1, 450, 370.2, 139/435.5, 435.6, 452

[56] References Cited

U.S. PATENT DOCUMENTS 4,565,224 1/1986 Keller ..... 139/370.2
4,607,668 8/1986 Tholander ..... 139/452

FOREIGN PATENT DOCUMENTS 0004836 10/1979 European Pat. Off. .
0097939 1/1984 European Pat. Off. .
0164773 12/1985 European Pat. Off. .
0162839 8/1985 Japan ..... 139/435.1

*Primary Examiner*—Andrew M. Falik
*Attorney, Agent, or Firm*—W. G. Fasse; D. H. Kane, Jr.

[57] ABSTRACT

A weft thread monitor for an air weaving loom with air jets for inserting weft thread yarns of different qualities such as coarse, fine, thick or thin yarns into the loom shed, has an amplifier or comparator controlled in response to control signals which represent the different yarn qualities for providing a loom control signal which is substantially independent of these yarn qualities. The different quality yarns are pulled off from thread storage spools. The air jets of the main nozzles and of relay nozzles are controlled by an air jet insertion control forming part of a central processing unit. The weft thread monitor with its monitoring or sensor element or elements is arranged at the exit side of the air channel formed by profiled reed teeth of the air jet loom. The output of the sensor element is connected to the input of the amplifier or comparator. A uniform output signal from the amplifier or comparator is assured for all types of weft threads regardless of the yarn specific quality, by controlling the amplifier gain or the comparator threshold, for compensation in response to these yarn qualities. Thus, a very thin smooth yarn or a very thick, corase yarn will yield the same resulting output signal.

7 Claims, 3 Drawing Sheets

WEFT THREAD MONITOR WITH CONTROL CIRCUIT TO ELIMINATE FALSE WEFT DEFECT SIGNALS

FIELD OF THE INVENTION

The invention relates to a weft thread monitor for air jet looms equipped with air jet means for inserting weft thread yarns of different qualities into the weft thread insertion channel. The monitor produces a loom control signal.

BACKGROUND INFORMATION

In air jet looms several types of weft thread may be used for obtaining special fabrics and fabric effects. Each weft thread is pulled off its respective weft thread supply spool and taken over by weft thread insertion nozzles, including a main nozzle located at a weft thread insertion side of the loom shed and a plurality of auxiliary nozzles arranged alongside the weft thread insertion channel formed by the reed and passing through the loom shed. The nozzles are controlled by a central control unit including air insertion control means to provide the proper required air stream in the air channel formed by profiled teeth of the reed. A weft thread monitor is arranged at the weft thread exit side of the weft thread insertion channel for monitoring the presence or absence of a weft thread. A control signal is produced, for example, to stop the loom in response to a broken weft thread. The weft thread monitor comprises monitoring elements such as light emitting and light sensing elements which produce the mentioned control signal which is supplied to the input of an amplifier.

Conventional weft thread monitors of this type are capable to some extent to distinguish yarn qualities, however, a precise distinction or rather high resolution is not possible with conventional weft thread monitors because thick coarse threads and very fine threads cannot be distinguished from each other. Pseudo-faults such as harmless lint or fluff particles passing through the monitor may cause a false shut-off signal. Such monitoring errors may be made quite frequently by conventional monitors.

In a situation in which a conventional weft thread monitor is supposed, for example, to recognize a very fine weft thread yarn, it is necessary to provide a high amplification factor or gain for the signals received from a light barrier through which the fine weft thread is passing. On the other hand, a substantially smaller amplification or gain is required where a weft thread of substantial thickness is being monitored because such a thicker weft thread can be optically monitored much more easily. In other words, in conventional weft thread monitors the output signal of the monitoring elements depends very much on the mechanical characteristics of the weft thread yarn so that a thick yarn is easily monitored while a very fine or thin yarn cannot be sufficiently monitored or sensed. However, increasing the amplification when a fine weft thread yarn is monitored can cause the problem that the amplification is much too high when the yarn thickness suddenly changes. As a result, even a yarn slub or fluff particle can cause the generation of a false warning signal by the weft thread monitor. Substantial weaving errors or flaws can be the result of such conventional weft thread monitoring. Conventional monitors of this type, in addition to not being able to react equally to thick and thin weft threads, also cannot well respond to different air effective qualities of different types of weft thread yarns. The term "air effective qualities" refers to thread characteristics which have an effect on the movement of the weft thread through the air and on the movability of the thread by the inserting air jet. For example, a coarse, hairy yarn with a rough surface responds differently to the transporting air jet than a yarn with a smooth surface. Similarly, a coarse yarn produces more lint balls or fluffs than a fine smooth surfaced yarn. Neither different mechanical yarn qualities nor the air effective yarn qualities must cause a false shut-down signal. Conventional monitors of this type leave room for improvement in this respect.

The mechanical yarn qualities such as the yarn thickness and the air effective yarn qualities together are referred to as yarn specific values in the following text.

OBJECTS AND SUMMARY OF THE INVENTION

In view of the above it is the aim of the invention to achieve the following objects singly or in combination:

to improve a weft thread monitor in such a manner that the quality and level of the monitor produced control signal for controlling loom functions is substantially independent of the yarn specific qualities of the different weft thread yarn types;

to automatically control the gain of the monitor's signal amplifier in response to a signal representing said yarn specific qualities;

to automatically control a threshold level of a comparator, which compares the monitor output signal with said threshold level, in response to said yarn specific qualities;

to store yarn specific values in the memory of a central loom control unit such as a CPU;

to measure yarn specific values and produce respective control signals for the production of the loom control signal based on the signal provided by the weft thread monitor; and to make sure that yarn slubs, do not falsify or generate an unintended or pseudo fault signal at the output of the monitor amplifier to thereby avoid producing pseudo-fault signals.

According to the invention there is provided a weft thread monitor for an air jet weaving loom with a weft thread insertion of yarn threads of different qualities, wherein each yarn thread is pulled off its respective thread storage spool and inserted by main nozzles and relay nozzles into the air channel formed by profiled reed teeth. The nozzles are controlled by an air insertion control of the CPU. The weft thread monitor with its monitoring elements is arranged on the exit side of the air channel. The signal produced by the monitor is processed through a signal processing circuit such as a comparator or an amplifier which is controlled by a control signal containing or representing either stored or currently measured yarn specific values. Thus, the yarn specific signal is a correction signal which makes sure that the output signal of the weft thread monitor is independent of adverse influences to avoid producing loom shut down signals which would merely represent a pseudo-fault but not a real fault.

The gist of this invention is thus an automatically programmable signal amplification or signal comparing of the weft thread monitor output signal in accordance with current weft thread specific values to make the weft thread monitor output signal independent of the mechanical and air effective yarn qualities. Stated differently, the control output signal produced by the monitor shall be independent of the adverse effects which the mechanical and air effective qualities of the yarn may have on the signal generation. Thus, loom shut down by a harmless floss, for example, is avoided.

The present monitor has substantial advantages compared to known weft thread monitors. Yarn slubs, lint balls, etc. can now be recognized without causing a loom shut down, e.g. when the type of weft thread is changed.

In operation the weft thread monitor or rather its comparator or amplifier is so controlled in a closed loop fashion, so that its electrical output signal achieves a certain output signal level for controlling the loom.

If now the thread type is changed and instead of a fine yarn a thicker yarn is used, then this fact is supplied to the amplifier or comparator of the weft thread monitor by way of a respective correction signal representing the currently relevant thread specific value, whereby the output signal of the weft thread monitor is correspondingly reduced for the thicker yarn. Now, it could happen in connection with a thread change, that ahead of the thicker yarn to be inserted into the loom shed, a yarn slub or the like was passing through the weft thread monitor. In conventional weft thread monitors this fact would have resulted in an output signal representing a pseudo-fault signifying that the thicker yarn has appeared at the exit side of the loom shed, while in fact, the thicker yarn has not yet been passed fully through to the exit side.

However, since, according to the invention the weft thread monitor has been corrected in its output signal in accordance with the thicker yarn specific value so that its output signal is reduced because the amplifier gain was adjusted to a smaller value, the preceding yarn slug is not recognized anymore. Rather, the weft thread monitor recognizes correctly that the thicker yarn has not yet reached the exit side. Thus, weaving faults can be avoided.

According to an advantageous embodiment several weft thread monitors are arranged in series or rather in a row along the weft thread travel direction. Here again, each monitor has its own signal amplifier or signal comparator. The output signals are controlled in closed loop fashion in response to the yarn specific values. Such a series arrangement of several weft thread monitors is known as such, however, not with the present control. The purpose of such series arrangement is to recognize the tail end of an out-running weft thread, namely when the tail end of the thread has been pulled off its spool which thus became empty or when a thread broke. If the second weft thread monitor arranged behind the first weft thread monitor on the exit side ascertains such a thread end, then it is assured that a faulty thread is involved. This is so, because a normal thread reaches only through the first monitor since the normal thread is still under control of the spool from which it is reeled off. On the other hand, a loose thread end is no longer under the control of its spool and hence is blown through both monitors. This fact is evaluated to produce a proper shut down signal.

According to the invention the second weft thread monitor or several additional monitors are controlled in closed loop fashion with regard to their output signal in response to the yarn specific values so that in this manner an increased accuracy is achieved in the thread monitoring.

Different physically operating devices are suitable for use as the weft thread monitor or monitors, for example, optical weft thread monitors which operate by passing light through the weft thread or which operate with reflected light are useful. Also, capacitively or inductively operating weft thread monitors are suitable.

A light source for an optical weft thread monitor may be a laser light source or an infrared light source or other light sources.

In accordance with a special embodiment the amplifier of the weft thread monitor is connected with the loom's CPU also operating as an air insertion control. Signal bus conductors are used for this purpose, whereby the amplifier gain is electrically controlled with regard to the yarn specific values stored in a memory of the CPU. Advantageously, in this connection the amplifier of the weft thread monitor is constructed as an automatically programmable amplifier depending on the yarn specific values.

In an especially advantageous embodiment the CPU comprises manual and/or automatic programing means which permit entering the yarn specific values into the memory of the computer forming part of the CPU. These values are then supplied to the amplifier gain control input or to the threshold value control input of a comparator.

The amplifier of the weft thread monitor advantageously supplies an output signal to the CPU or the air insertion control thereof, independently of the types of yarn presently being inserted In other words, the produced output signal should be the same regardless whether a thick or thin weft thread passed through the monitor.

Any digital signal processing of the weft thread specific values of the yarns may take place in the amplifier itself rather than in the CPU.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
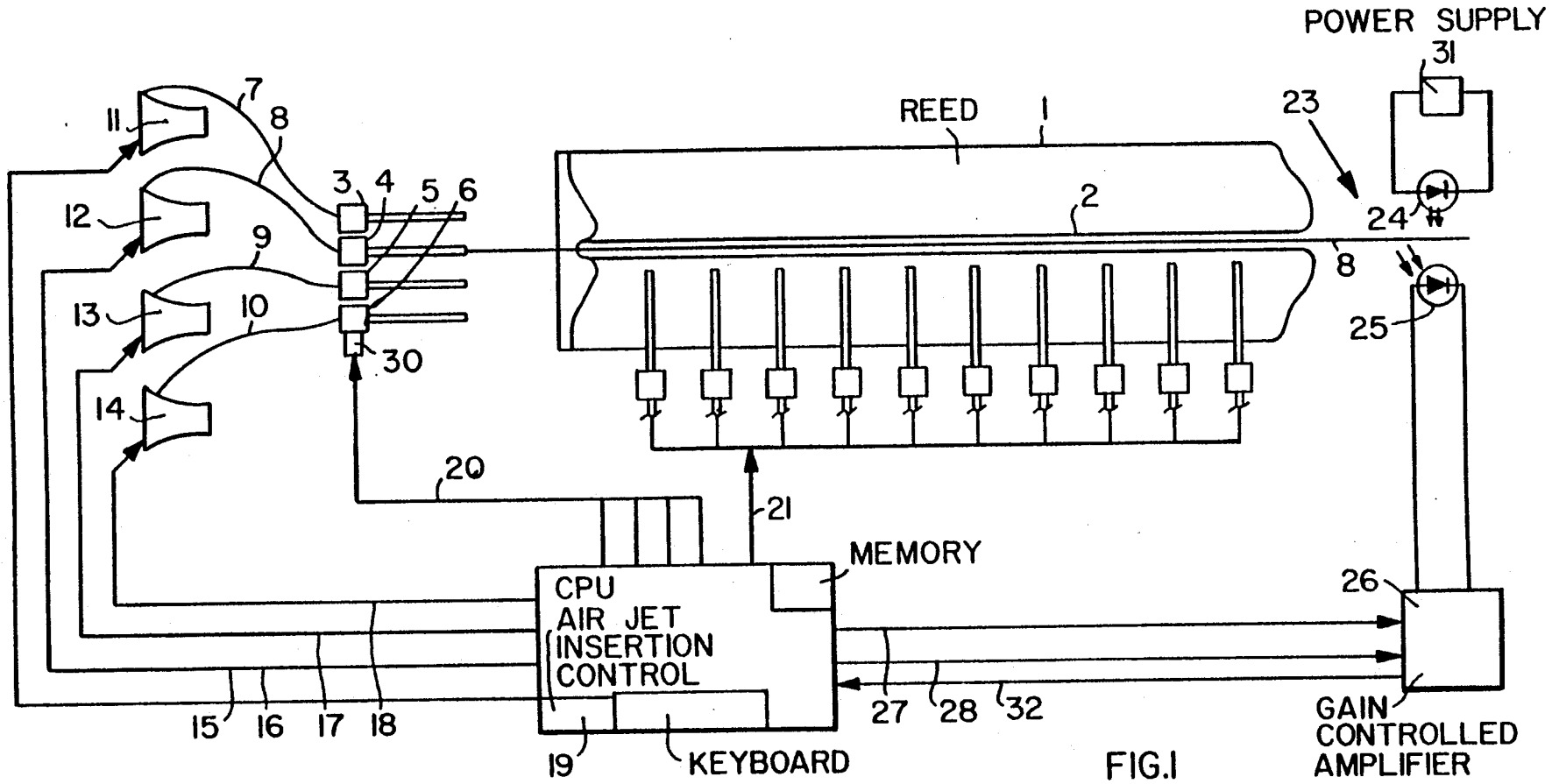
FIG. 1 is a schematic block diagram of an air jet loom equipped with a central processing unit and with a weft thread monitor according to the invention including a gain controlled amplifier.

Referring to FIG. 1 of the drawings, a loom comprises a profiled reed 1 which forms with its reed teeth a weft thread insertion air channel 2. Depending on the weaving pattern, yarn weft threads 7, 8, 9, and 10 are inserted into the air channel 2 by means of several main nozzles 3, 4, 5, and 6. The yarns 7, 8, 9, 10 are pulled off from thread storage devices, such as bobbins or reels 11, 12, 13, and 14. Signal conductors 15, 16, 17, and 18 connect a central processing unit CPU which includes a conventional air insertion control 19, with the individual thread storage devices 11 to 14 for individually operating a reel drive means or brakes not shown. In accordance with the weaving pattern, the individual thread storage device 11 to 14 is switched on or operated through the corresponding signal conductor 15 to 18 so that the respective thread storage device delivers the weft thread yarn that is to be currently inserted into the air channel 2 by the respective main nozzle 3 to 6 located opposite the air channel 2.

The air insertion control 19 controls through the signal conductor bus 20 also the electrically controlled air valves 30 arranged individually for each of the main nozzles 3 to 6 in order to release air into the main nozzles 3 to 6. Only one valve 30 is shown for simplicity's sake, but each nozzle has its own valve and each valve has its own control conductor forming part of the bus 20.

Relay nozzles 22 are controlled by the air insertion control 19 through a other signal conductor forming part of the conductor bus 21. Each relay nozzle also has its own electrically air valve.

On the exit side there is arranged a weft thread monitor 23 comprising a light source 24 such as a laser, an infrared light source or the like having its own power supply 31 and a sensor element 25. The sensor element 25 is connected with its output to an amplifier 26 which is connected through signal conductors 27 and 28 with the CPU which includes a memory in which the above mentioned weft thread specific values are stored, for example 33 d tex for yarn thread 7, 500 d tex for thread 8, 1000 d tex for thread 9 and so on. These values are readily available from the thread manufacturer, and may be stored in the CPU's memory through the keyboard or even automatically by a respective program. The memory also has stored therein air effective values for the individual threads. These air effective values are ascertained empirically and will depend on the surface of the thread, e.g. smooth surface factor 1, rough surface factor 2, hairy surface factor 3, etc. Conductors 27, 28 supply these values as respectively programmed signals to the gain control input of the amplifier 26 for electrically controlling the gain of the amplifier 26 in response to the values, thereby assuring a uniform control signal for all types of yarns on the amplifier output conductor 32 which supplies this signal to the CPU for use in the loom control, e.g., to stop the loom when a true fault has been detected and to avoid stopping the loom merely by a pseudo-fault.

The manual or automatic programming ascertains the mechanical and air effective characteristics represented by the thread specific values of the yarns 7 to 10 and processes these characteristics as electrical signals in the CPU. These electrical signals are converted into programming signals for the gain control of the amplifier 26 as described. Thus, the amplifier 26 has a programmable amplification or gain control. It is the aim of the entire programmable amplification that for all types of threads a uniform output signal of the amplifier 26 is obtained independently of the mechanical and air effective characteristics of the individual yarn threads passing through the light barrier between the elements 24 and 25. The digital processing can take place in the amplifier 26 itself or in the CPU.

Obtaining a uniform output signal independently of the yarn characteristics is important because, for example, a change from a thick weft thread to a thin weft thread cannot cause an unintended fault signal.

The gist of the invention thus is an automatically programmable amplification of the amplifier 26 with the aim to always obtain a uniform output signal from the amplifier of the weft thread monitor independently of the yarn type. The thread specific values could also be produced in the loom itself, e.g., by measuring the thickness of the threads and using the measuring results for the gain control.

Figure 2:
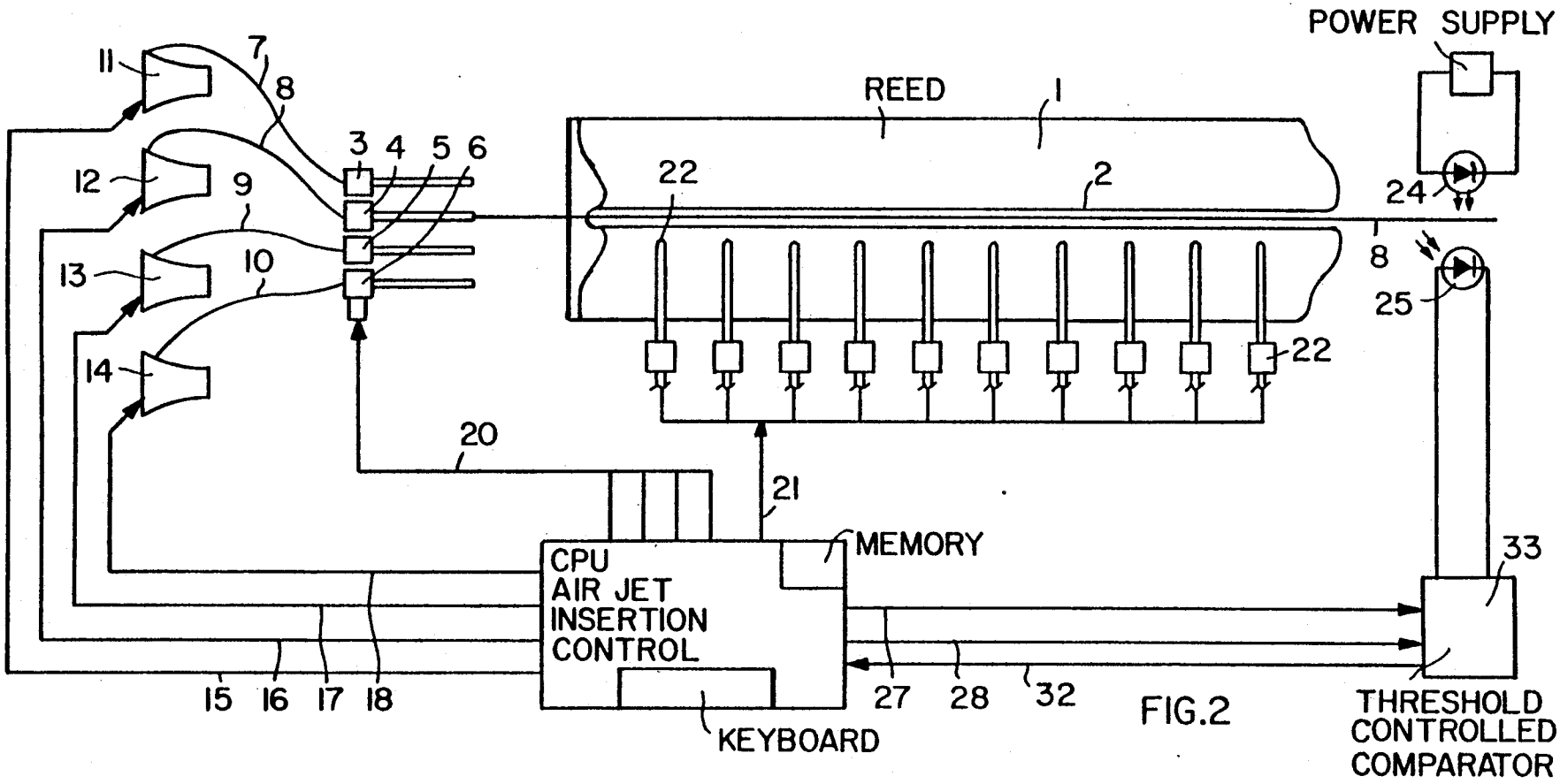
FIG. 2 is a diagram as in FIG. 1, however, with a threshold controlled signal comparator instead of the amplifier.

FIG. 2 shows an embodiment in which the amplifier 26 has been replaced by a comparator 33 having a threshold control input connected to said thread specific value signal conductors 27, 28. The comparator also delivers an output control signal to the CPU which is uniform for all types of threads.

Figure 3:
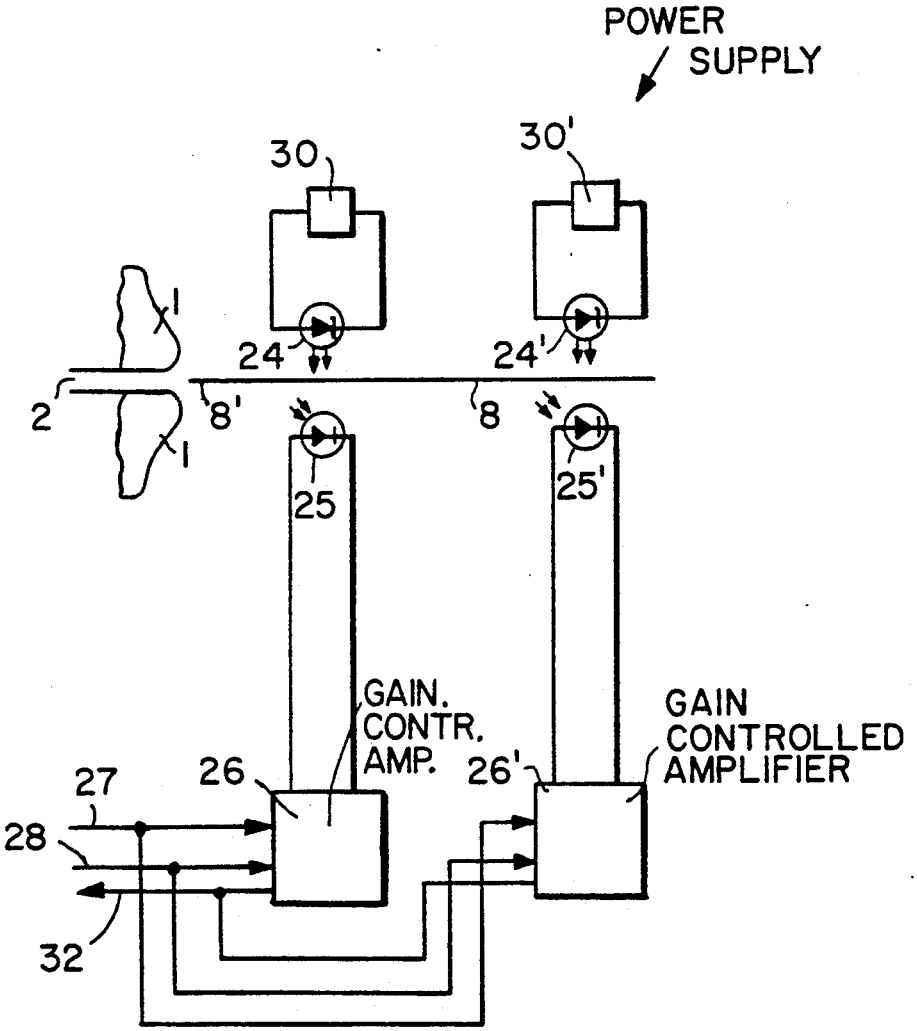
FIG. 3 shows the arrangement of two comparators arranged in a row along the travel direction of the weft thread for discovering a weft thread end or a broken weft thread.

FIG. 3 shows two weft thread monitors arranged in a row along the travel direction of the weft thread 8. Thus, when the thread end 8' reaches the second sensor 25' a signal will be produced by the gain controlled amplifier 26' that indicates a creel is now empty or a thread broken. Light source 24' has its own power supply 30'. Here also, the amplifiers could be exchanged for the threshold controlled comparators which compare the output signal from the sensors 25, 25' with a threshold value that is established by the CPU in response to the relevant thread specific values as in FIG. 2.

Although the invention has been described with reference to specific example embodiments it will be appreciated that it is intended to cover all modifications and equivalents within the scope of the appended claims.

What we claim is:

1. A weft thread monitor for an air weaving loom with a weft thread insertion of yarns of different qualities, wherein the yarns are pulled off from a thread storage and inserted into an air channel of a profiled reed by a CPU including air insertion channel means for main nozzles and relay nozzles, comprising a memory in said CPU having stored therein different mechanical and/or air effective yarn characteristics, a weft thread monitor including a signal processing circuit and monitoring elements arranged at an exit side of said air channel, said monitoring elements having output monitoring signals connected to a first input of said signal processing circuit, said signal processing circuit having a second input forming a gain control or threshold control input to witch a yarn signal from said memory of said CPU is supplied, said yarn signal representing said different mechanical and/or air effective yarn characteristics of the respective yarn (7 to 10), whereby a control output signal from said signal processing circuit is uniform for all types of yarns being monitored for stopping said air weaving loom in response to said control output signal produced as a result of a true fault independently of said thread types.

2. The monitor of claim 1, wherein a plurality of weft thread monitors (23) is arranged in a row, said signal processing circuit comprising amplifiers producing output signals which are controlled in closed loop fashion in dependence on said yarn characteristics.

3. The monitor of claim 1, wherein said signal processing circuit of said weft thread monitor (23) comprises an amplifier (26) connected through signal conductors (27, 28) with said CPU for electrically controlling the gain of said amplifier (26) in accordance with yarn characteristics provided by a memory in the CPU.

4. The monitor of claim 1, wherein said signal processing circuit of said weft thread monitor comprises an amplifier (26) constructed as a programmable amplifier depending on said mechanical and air effective characteristics of said yarns.

5. The monitor of claim 4, wherein said CPU comprises programming means for storing said mechanical and air effective characteristics of said yarns (7 to 10), and signal conductor means connecting said CPU to said amplifier (26) for supplying said yarn characteristics as programming signals from said CPU to said amplifier (26).

6. The monitor of claim 5, wherein said amplifier (26) of said weft thread monitor (23) provides an output signal to said CPU which signal is uniform for all types of yarns.

7. The monitor of claim 1, wherein said signal processing circuit comprises means for digital signal processing of said yarn characteristics of the yarns (7 to 10).

* * * * *